United States Patent [19]

Roberts et al.

[11] Patent Number: 4,605,475

[45] Date of Patent: Aug. 12, 1986

[54] GAS SEPARATION PROCESS

[75] Inventors: Daryl L. Roberts, Fremont; Richard M. Laine, Palo Alto, both of Calif.

[73] Assignee: SRI International, Menlo Park, Calif.

[21] Appl. No.: 695,440

[22] Filed: Jan. 28, 1985

[51] Int. Cl.[4] ..... C25F 5/00

[52] U.S. Cl. ..... 204/130; 204/129; 204/263; 204/265; 204/266; 423/219; 423/226; 423/228; 55/68

[58] Field of Search ..... 204/129, 130, 131, 59 QM, 204/263, 265-266, 59 R; 423/219, 226, 228, 579; 55/68

[56] References Cited

U.S. PATENT DOCUMENTS 3,773,632 11/1973 Lehmkuhl ..... 204/59 QM
4,343,715 8/1982 Bonaventura et al. ..... 252/186
4,396,475 8/1983 Stehlík ..... 204/130
4,427,416 1/1984 Bonaventura et al. ..... 23/293 R
4,451,270 5/1984 Roman ..... 55/38
4,475,994 10/1984 Gagné et al. ..... 204/250

*Primary Examiner*—R. L. Andrews
*Attorney, Agent, or Firm*—Limbach, Limbach & Sutton

[57] ABSTRACT

A process for separating oxygen from gas mixture containing oxygen is disclosed. The gas mixtures are contacted with a solution of an organometallic complex oxygen carrier and an electrolyte in an organic solvent. During the contact, oxygen is bound to the carrier. After the contacting step is completed the solution is electrochemically oxidized with resultant release of oxygen which is recovered. The solution is then electrochemically reduced bringing the oxygen carrier to its original condition and ready for reuse.

3 Claims, 5 Drawing Figures

GAS SEPARATION PROCESS

DESCRIPTION

Technical Field

Oxygen has been separated from gas mixtures containing oxygen by contacting such mixtures with organometallic complexes commonly termed "oxygen carriers". During the contact oxygen is bound to the carrier complexes. After all or a substantial part of the capacity of the carrier to bind oxygen to it has been exhausted the carrier complex is removed from further contact with the feed gas and the bound oxygen is separated from the carrier. In the past this separation has been made either by raising the temperature of the carrier containing bound oxygen causing release of the oxygen from the carrier or by introducing the carrier containing bound oxygen into a zone in which the pressure above the carrier is substantially below atmospheric pressure and this pressure reduction causes release of the bound oxygen. After release of the bound oxygen from the carrier, the carrier may be returned to further contact with the feed gas to repeat the binding of oxygen to the carrier.

The metal complex carriers are commonly dissolved in a solvent and the feed gas is contacted with a solution containing the carrier. The gases other than oxygen contained in the feed gas commonly dissolve to an appreciable extent in the solvent and when either reduction of pressure or elevation of temperature is employed to release the bound oxygen the dissolved nonoxygen components of the feed gas are also released, reducing the purity of the oxygen recovered.

Pursuant to the present invention, the oxygen carriers heretofore used and others are employed to bind oxygen to the carrier, but the release of bound oxygen from the carrier and reactivation of the carrier for further use in binding oxygen is accomplished electrochemically. There is no pressure reduction and no temperature rise and the dissolved gas in the solution of the metal complex carrier is not much released along with the oxygen released by the electrochemical reaction.

BRIEF DESCRIPTION OF THE INVENTION

Pursuant to the present invention, a solution is prepared which contains a polyvalent metal complex oxygen carrier, an electrolyte and a solvent. The three components of the solution must be chemically compatible with each other in the sense that they do not interact with each other. The solvent must be capable of dissolving sufficient of the oxygen carrier to give a molar concentration of at least 0.01 and preferably a higher concentration up to about 5 molar. The solvent must also be capable of dissolving a substantial quantity of the electrolyte selected and if desired may be capable of dissolving a moderate amount of water which permits the use of electrolytes, other than organic electrolytes, which may not be sufficiently soluble in the solvent itself to be useful. In preparing the solution the metal of the oxygen carrier is at a lower valence. An oxygen containing feed gas is then passed through the solution until a substantial proportion of the capacity of the carrier to bind oxygen is exhausted. The product of this contact with the feed gas is then subjected to electrochemical oxidation which raises the valence of the metal of the oxygen carrier to a higher level and this oxidation concurrently releases oxygen. The released oxygen is removed and the oxidized carrier is then electrochemically reduced to bring the metal component of the carrier back to its lower valence and so to restore its capability to bind oxygen. The sequence of contact of the solution with the feed gas, electrochemical oxidation to release bound oxygen and then electrochemical reduction of the oxygen carrier to bring the metal to its lower valence level is repeated over and over as the process is carried on.

DETAILED DESCRIPTION OF THE INVENTION

As indicated above, the solution employed in the process of the invention for removing oxygen from gaseous mixtures of oxygen and other gases consists of three components, a polyvalent metal complex oxygen carrier, an electrolyte and a solvent.

Polyvalent metal complex oxygen carriers are well-known in the art and have been extensively described in the literature.

Niederhoffer, Timmons and Martell in *Chemical Reviews* 1984, Vol. 84, No. 2, beginning at Page 137, set forth an extensive review of the literature relating to metal complexes which reversibly bind dioxygen ($O_2$), chemically identify a great many complexes and provide equilibrium constants for the reactions of polyvalent metal complexes with oxygen in organic solvent. The numerous polyvalent metal complexes set out in Tables XXXIIID, XXXIIIE and XXXIIIF, which appear on pages 179 through 185 of the publication are suitable for use as oxygen carriers in the process of the invention.

Kimura et al in *Journal of the American Chemical Society*, 1984, Vol. 106, pp 5497–5505, describe a number of nickel complexes which are oxygen carriers and are suitable for use as such in the present invention.

Schiff base complexes of the following two formulas and their analogs have been found effective oxygen carriers for use in the process of the invention.

COMPLEX I

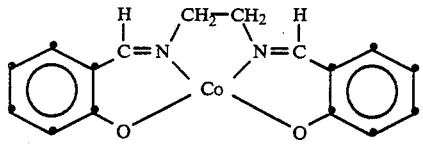

COMPLEX II

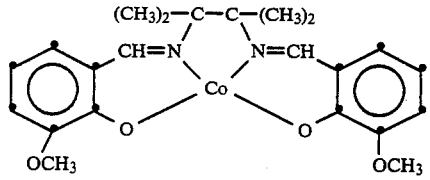

Analogs of these two compounds include those in which the polyvalent metal is a transition metal, preferably iron, nickel, manganese, rhodium, copper and ruthenium instead of cobalt, and in which the oxygen atoms are replaced by another elementor group such as sulfur or $NH_2$.

The electrolyte component of the solution may be any electrolyte which is soluble in the solvent employed and which is chemically compatible with the solvent and with the oxygen carrier complex. Quarternary ammonium salts, such as tetrabutyl ammonium fluoborate, tetrabutyl ammonium chloride and other tetraalkyl ammonium salts of inorganic acids are suitable electrolytes. Quarternary phosphonium salts are also suitable electrolytes. When the solvent employed has the capacity to dissolve a reasonable amount of water then electrolytes such as sodium chloride and the like which may not be soluble in the solvent without the water being present may be employed with the result that the range of electrolytes which it is feasible to employ is greatly extended.

The solvents employed are organic solvents, preferably polar organic solvents, such as dimethylformamide, N-methylpyrrolidone, dimethylsulphoxide and generally lactones, lactams, amides, amines and the like. The essential property requirements of the solvent are that it be capable of dissolving the metal complex oxygen carriers in amount to provide concentrations at least 0.01 molar and up to much higher concentrations, such as 5 molar, and that it also be capable of dissolving the electrolyte employed in amount sufficient to provide a high level of electrical conductivity to the total solution, and that further that it be chemically compatible with both the oxygen carrier and with the electrolyte employed.

BRIEF DESCRIPTION OF THE DRAWINGS

In the following further description of the invention, reference will be made to the appended drawings, of which.

DETAILED DESCRIPTION OF THE DRAWINGS

The release of oxygen by electrochemical oxidation of a carrier onto which oxygen has been bound and the reactivation of the carrier species by electrochemical reduction has been demonstrated in a small laboratory apparatus. Experiments in this apparatus have served to demonstrate the electrochemical principles of the invention.

Experiments were conducted in a 30 ml glass container (cell). Platinum wire (0.5 mm diameter) spiral electrodes were used as the test and the counter electrodes. The electrode area exposed to the solution was 0.63 $cm^2$. The reference electrode was a saturated calomel reference electrode. The potential of this electrode with respect to the standard hydrogen electrode is +0.242 V. The electrodes were fitted to the cell in such a manner that the test electrode and the reference electrodes were in close proximity to minimize IR drop.

All experiments were conducted in the cell with 10 ml of N-Methyl-pyrrolidone (NMP) and 0.2 g of tetrabutyl ammonium tetrafluoborate ($BU_4NBF_4$). The NMP served as the solvent, and the $Bu_4NBF_4$ served as the electrolyte. The electrodes were totally immersed in the solution. The cell was designed such that air or argon could be sparged through the solution when desired. The container temperature was maintained at 5° C. The solution was stirred when desired with a magnetic stirrer.

To investigate the electrochemical behavior of the system, the current passing through the solution was monitored as the voltage of the test electrode was varied. This technique, known as cyclic voltammetry (CV), is a standard technique for observing electrochemical reactions, described in "Electrochemical Methods", Bard & Faulkner, John Wiley & Sons, New York 1980. The technique relies on the principle that in any given electrolyte system, a given electrochemical reaction will occur at a specific potential. For example, tables of Standard Reduction Potentials (e.g. in the Handbook of Chemistry and Physics, 52nd edition, page D-111) indicate the potentials at which hundreds of reactions occur in aqueous solution. Consequently, in cyclic voltammetry, electrochemical reactions appear as waves in the plot of current versus applied potential.

Cyclic voltammetry was used to identify three electrochemical reactions: (1) the oxidation of the carrier, (2) the reduction of the carrier, and (3) the reduction of dissolved molecular oxygen. Observation of the first two electrochemical reactions serves to demonstrate the ability to oxidize and reduce the oxygen carrier complex, and observation of the third reaction serves to identify the presence of dissolved molecular oxygen in solution.

Figure 1:
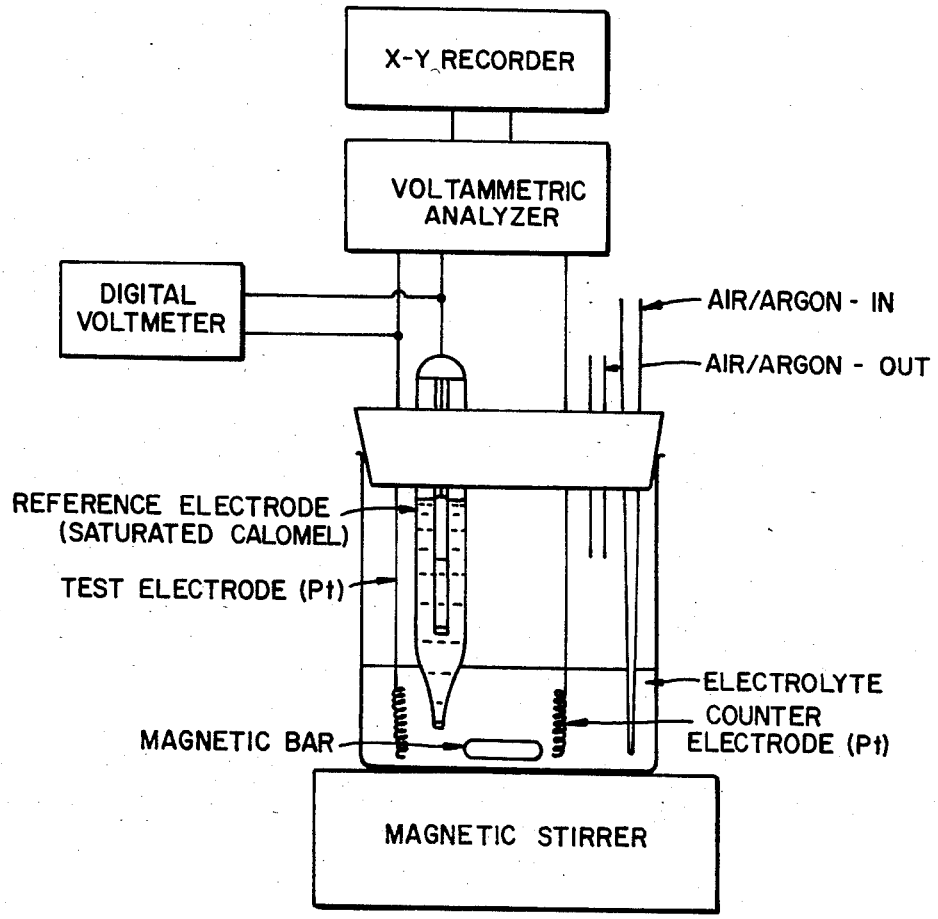
FIG. 1 is a side view of a cell and experimental set-up for making cyclic voltammetric scans.
Figure 2:
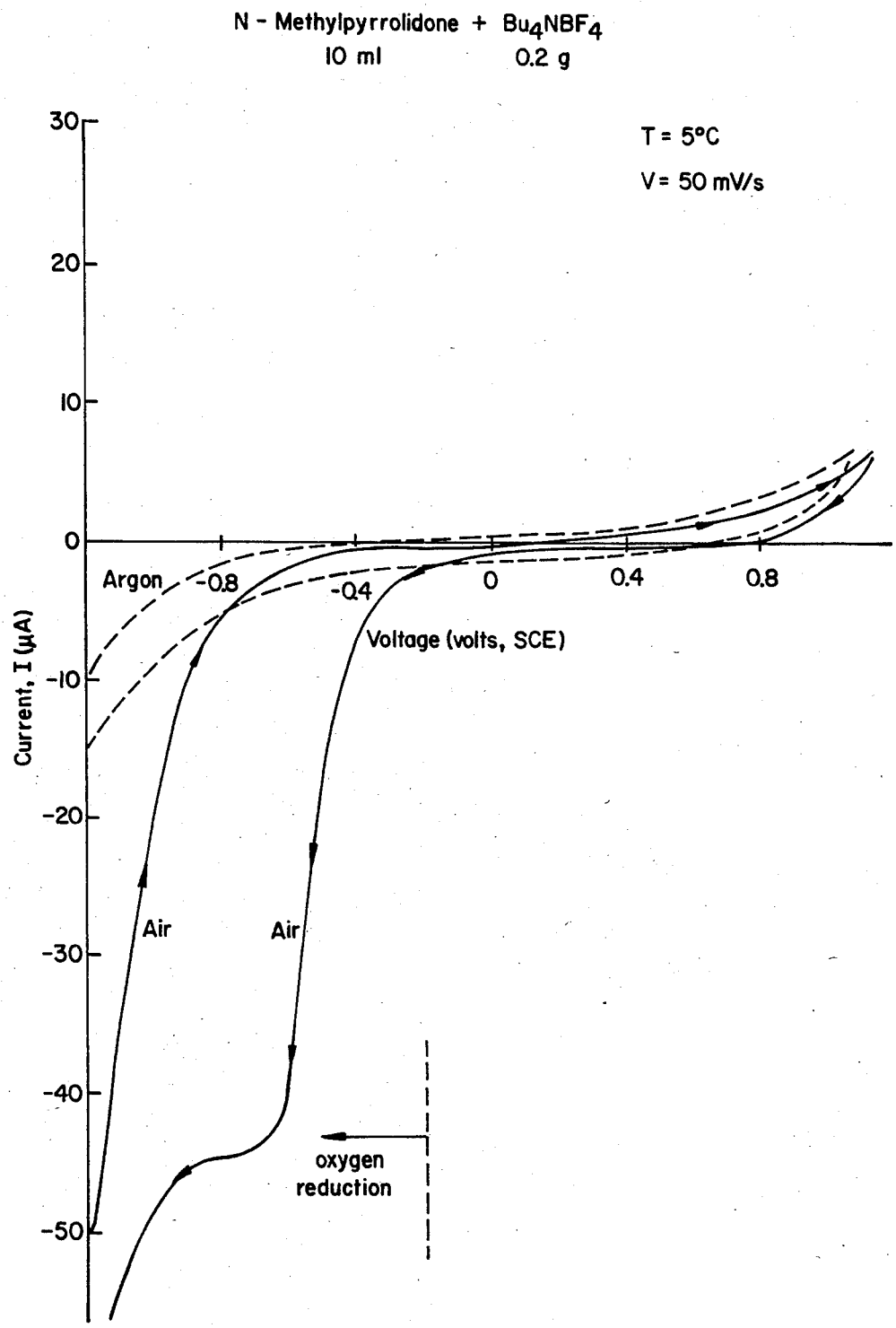
FIGS. 2, 3 and 4 are graphic representations of cyclic voltammetric scans.

To identify the potential at which dissolved molecular oxygen is reduced and to prove that the solvent and electrolyte do not undergo electrochemical oxidation or reduction, cyclic voltammetry was performed on the solution in the absence of carrier (i.e. only 10 ml NMP and 0.2 g $Bu_4NFB_4$). In one case argon was bubbled through the solution for 15 minutes prior to the CV scan. In the next case air was bubbled through the solution for 15 minutes prior to the CV scan. There were no electrochemical reactions observed in the argon scan, whereas in the presence of dissolved molecular oxygen, FIG. 2 shows an electrochemical reaction at −0.43 V. This reaction is the electrochemical reduction of oxygen. Therefore, in this electrolyte system, the waves at −0.43 V in the current vs. voltage plot indicates the presence of dissolved molecular oxygen. These results are shown in FIG. 2 of the drawings.

Figure 3:
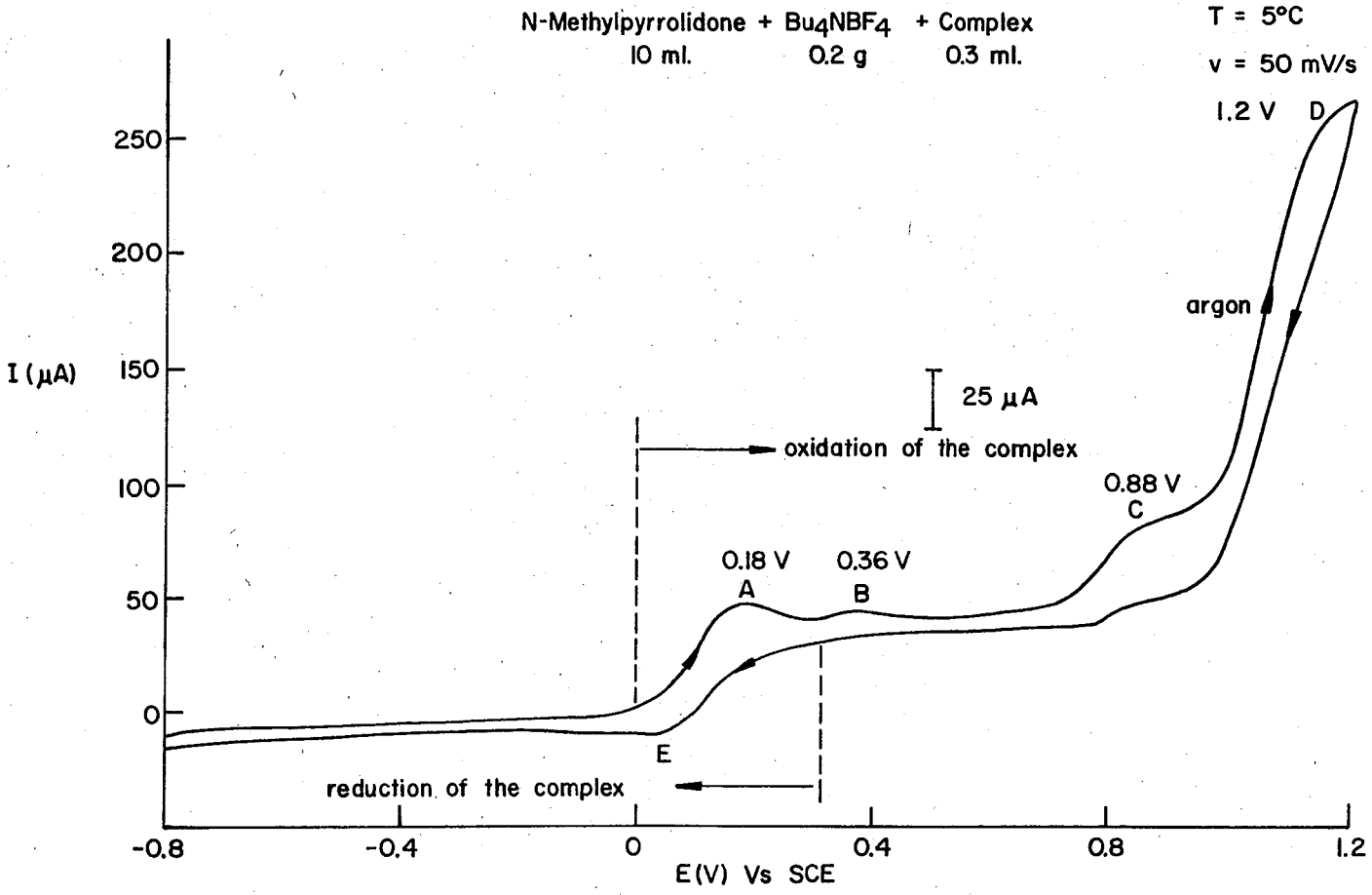

To identify the presence of the electrochemical reduction and oxidation of the carrier itself, argon was bubbled through the solution for 15 minutes and then added 0.3 ml of Complex-I (Salen) dissolved in NMP. A CV scan was run and electrochemical oxidation was observed at 0.18 V, 0.36 V, 0.88 V, and 1.2 V. In FIG. 3 electrochemical reduction is shown at 0.04 V. These experiments serve to show that oxidation and reduction of the carrier can be performed electrochemically and that the potential of this oxidation and reduction is such that there can be no confusion between the electrochemical oxidation or reduction of the carrier and the reduction of dissolved molecular oxygen. Therefore, when air is introduced into the system, the presence or absence of dissolved molecular oxygen can be established unequivocally.

Figure 4:
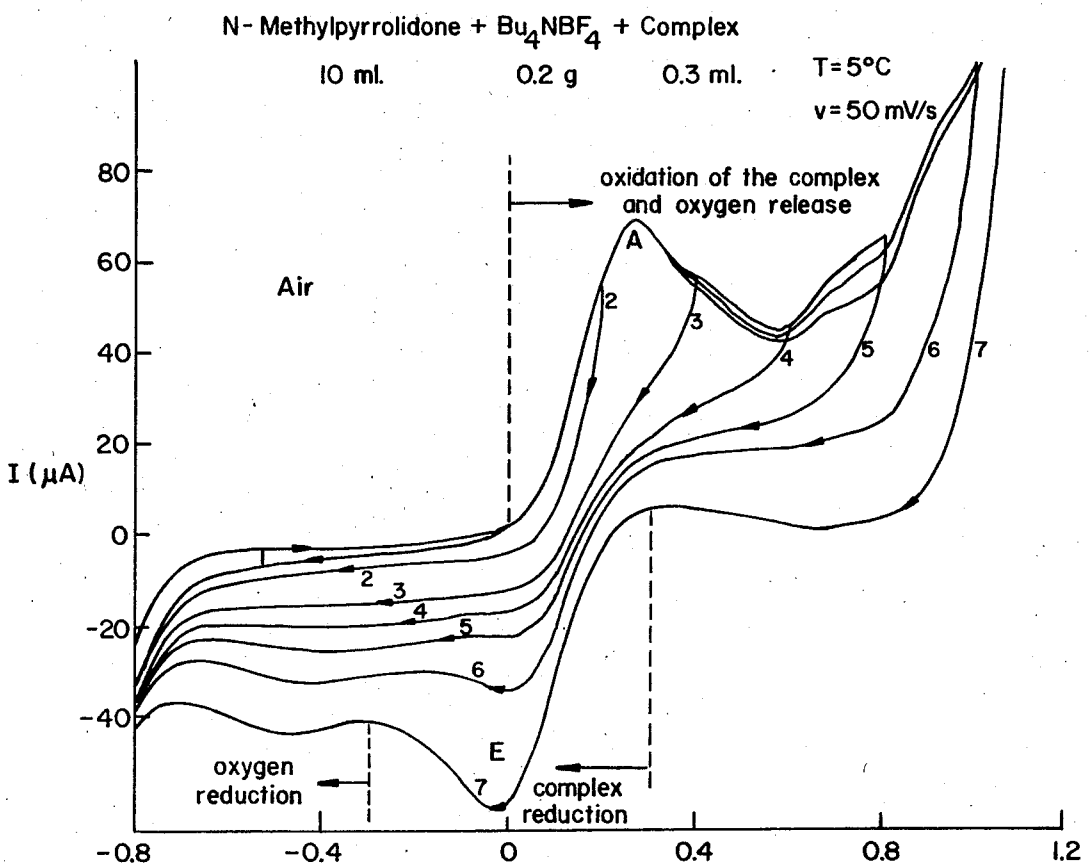

Having established the potentials at which the oxidation and reduction of the carrier occur and having established a method for indicating the presence of dissolved molecular oxygen, air was bubbled through the solution for 15 minutes. CV scans were then performed in which seven different peak voltages at which to reverse the scan were chosen. Referring to FIG. 4, scan curve 1 shows no oxidation of the carrier, it is apparent that there is no detectable dissolved molecular oxygen (i.e. if any is in the solution at all, it is bound to the carrier because there is no reduction wave near −0.43 V). As the peak scan voltage was increased waves indicating the oxidation and reduction of the carrier appear and the appearance of the wave near −0.43 V indicating the presence of dissolved molecular oxygen. Finally, at the highest peak voltage scan curve 7, a substantial oxygen reduction wave has appeared indicating the release of bound oxygen. The results show that without electrochemical oxidation of the carrier, no dissolved molecular oxygen is detectable, but that with electrochemical oxidation, bound oxygen is released to the solution. In a fully optimized commercial process, this dissolved oxygen, when released, would supersaturate the solvent with oxygen causing formation of oxygen bubbles which could be gathered as the product of the process. Further, the carrier #1 which normally degrades to an inactive peroxo dimer in a short time under the conditions employed, is readily reactivated through electrochemical oxidative decomposition of the peroxobridged dimer.

Figure 5:
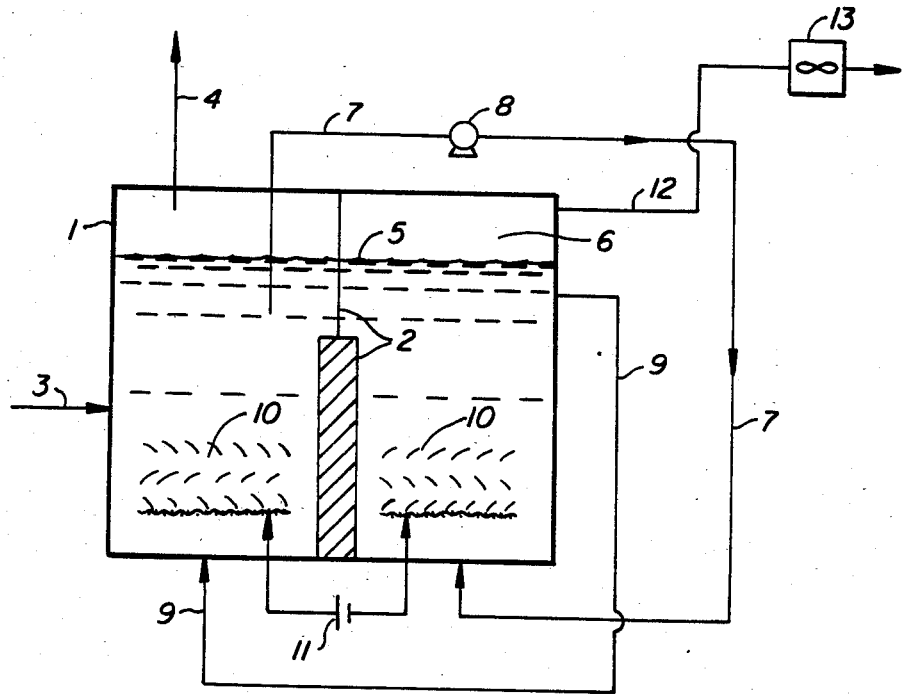
FIG. 5 is a side view of apparatus in which the invention may be practiced.

One embodiment of an apparatus assembly which may be used in carrying out the process of the invention is shown in FIG. 5 of the drawings. Vessel 1 is either a cylindrical or rectangular container for the solutions employed in the invention. The vessel is divided into two compartments of approximately equal volume by a central divider 2, the lower portion of the divider is a permeable membrane which may be loosely packed fiber or asbestos or the like which prevents intermixing of the liquids in the left-hand and right-hand compartments of the container but provides liquid electrolytic communication between the two compartments. The upper portion of the divider is a metal sheet. Feed gas is introduced through line 3 into the left-hand compartment of vessel 1. Line 4 is an exhaust line through which the feed gas depleted in oxygen content is removed from the compartment. The upper surface 5 of the solution lies at a level below the top of container 1 and provides a gas space 6 between the upper level of the liquid and the upper face of container 1. Solution is withdrawn from the upper part of the liquid body in the left-hand compartment through line 7 and is passed through that line into the bottom portion of the right-hand compartment of vessel 1. Pump 8 controls the rate of circulation of the liquid material. Liquid is withdrawn from the upper part of the right-hand compartment through line 9 and is passed through that line into the bottom part of the left-hand compartment. Gas enriched in oxygen is pulled through line 12 by fan 13. Metal mesh electrodes 10 are placed in the lower portions of the left-hand and right-hand compartments of the vessel. Cell 11 is connected to the two metal mesh electrodes, the left-hand electrode being the cathode and the right-hand electrode being the anode in the system.

Operation of the apparatus shown in the drawing is as follows. Vessel 1 is filled with a solution, such as any of the solutions shown in the above table. The vessel is not completely filled but a gas space several inches in height is left above the liquid level and the top of the vessel. After the solution is introduced into container 1, air is passed through line 3 into the left-hand compartment of the container until a substantial portion of the capacity of the solution to absorb oxygen has been exhausted. Pump 8 is then activated and the movement of solution between the two compartments is initiated. Passage of the electric current to the electrodes is initiated. Oxygen is taken up by the solution in the left-hand compartment of the vessel and air depleted in oxygen is withdrawn through line 4. The solution-containing carrier bound oxygen is then drawn through line 7 and introduced into the lower part of the right-hand compartment where it comes into contact with the anode. Through contact with the anode the metal component of the oxygen carrier is oxidized to a higher valence and the oxygen which is bound to the carrier is concurrently released. The released oxygen is withdrawn through line 12. Liquid is withdrawn from the upper portion of the right-hand compartment where the liquid contains the oxygen carrier metal at a higher valence and is passed through line 9 into the lower part of the left-hand compartment where it comes into contact with the cathode. At the cathode the metal component of the carrier is reduced to a lower valence and its capacity to bind oxygen is restored and further oxygen is picked up from the air introduced through line 3. Operation is continuous. Air is continuously introduced into the left-hand compartment of the vessel. Air depleted in oxygen is continuously withdrawn through line 4. Solution containing oxygen bound to the carrier is continuously passed through line 7 from the left-hand compartment to the lower part of the right-hand compartment, the oxygen carrier containing bound oxygen is continuously oxidized by contact with the anode and oxygen is continuously withdrawn through line 12 as product. Solution containing the metal carrier with its metal at a higher valence level is continuously withdrawn through line 9 and passed into the lower part of the left-hand compartment where it is contacted with the cathode and reduced to the lower valence level at which its capacity to bind oxygen is restored.

The process may be operated at temperatures in the range −30° C. to +100° C. Temperatures in the range −15° C. to 20° C. being preferable, the process is ordinarily but not necessarily operated at atmospheric pressure.

When very high purity oxygen is desired the oxygen recovered in the first contact of the solution containing bound oxygen with the anode may be accumulated and further purified by employing it as the feed gas.

We claim:

1. A continuous process for separating oxygen from gas mixtures containing oxygen comprises:

forming a solution consisting essentially of an organic solvent, an electrolyte and an organometallic complex oxygen carrier in which the metal is polyvalent and at a lower valence, the solvent, electrolyte and organometallic complex being chemically compatible, providing a closed vessel having a central vertical divider separating said vessel into two compartments, the lower portion of said divider being a permeable membrane and the upper portion of said divider being an impermeable sheet, an electrode disposed near the bottom of each of said compartments and a cell so connected to the electrodes that one becomes a cathode and the other an anode, said membrane being permeable in the sense that it prevents flow of said solution through it from either compartment to the other but provides liquid electrolytic communication between the compartments, introducing said solution into both compartments of said vessel in amounts such that the upper level of the solution in each compartment intersects the impermeable sheet of the divider, passing an oxygen containing gas into the cathode compartment of the vessel at a point near its bottom to cause oxygen absorption by said oxygen carrier and withdrawing gas depleted in oxygen from the top of the cathode compartment, withdrawing solution from the cathode compartment at a point near the upper surface of solution contained in the cathode compartment and introducing the withdrawn solution into the bottom of the anode compartment, to cause oxidation of the metal component of the oxygen carrier and release of absorbed oxygen, withdrawing gas enriched in oxygen from the top of the anode compartment; and withdrawing solution from the anode compartment at a point near the upper surface of solution contained in the anode compartment, and introducing the withdrawn solution into the bottom of the cathode compartment to cause reduction of the metal of the oxygen carrier to a lower valence.

2. A process according to claim 1 wherein the potential employed in the electrochemical oxidation and electrochemical reduction steps is in the range −0.8 to +1.5 volts relative to a standard calomel electrode.

3. The process defined in claim 1 wherein the solvent in N-methyl pyrrolidone, the organo-metallic oxygen carrier is a Schiff base polyvalent transition metal complex and the electrolyte is tetrabutyl ammonium fluoroborate.

* * * * *